US007165432B2

(12) United States Patent
Berendes et al.

(10) Patent No.: US 7,165,432 B2
(45) Date of Patent: Jan. 23, 2007

(54) METHOD AND DEVICE FOR CHANGING PAIRS OF WORKING ROLLS AND/OR PAIRS OF BACK-UP ROLLS ON ROLL STANDS

(75) Inventors: Andreas Berendes, Kirchhundem (DE); Armin Klapdor, Kirchhundem (DE)

(73) Assignee: SMS Demag AG, Düsseldorf (DE)

( * ) Notice: Subject to any disclaimer, the term of this patent is extended or adjusted under 35 U.S.C. 154(b) by 57 days.

(21) Appl. No.: 10/509,849

(22) PCT Filed: Apr. 17, 2003

(86) PCT No.: PCT/EP03/04049

§ 371 (c)(1),
(2), (4) Date: Oct. 1, 2004

(87) PCT Pub. No.: WO03/099479

PCT Pub. Date: Dec. 4, 2003

(65) Prior Publication Data

US 2005/0138982 A1 Jun. 30, 2005

(30) Foreign Application Priority Data

May 24, 2002 (DE) ..... 102 23 000

(51) Int. Cl.
*B21B 31/08* (2006.01)

(52) U.S. Cl. ..... 72/239; 72/238

(58) Field of Classification Search ..... 72/238, 72/239

See application file for complete search history.

(56) References Cited

U.S. PATENT DOCUMENTS

| | | | | |
|---|---|---|---|---|
| 3,583,195 | A * | 6/1971 | Sherwood | 72/239 |
| 6,763,565 | B1 * | 7/2004 | Mukaigawa et al. | 29/426.1 |
| 2002/0078728 | A1 | 6/2002 | Mukaigawa et al. | |

FOREIGN PATENT DOCUMENTS

| | | |
|---|---|---|
| DE | 3123933 | 2/1982 |
| EP | 1136143 | 9/2001 |

OTHER PUBLICATIONS

Patent Abstracts of Japan, vol. 004, No. 072 (M-013), May 27, 1980 & JP 55 036063 A (Hitachi Ltd) , Mar. 13. 1980.

* cited by examiner

*Primary Examiner*—Ed Tolan
*Assistant Examiner*—Debra Wolfe
(74) *Attorney, Agent, or Firm*—Friedrich Kueffner

(57) ABSTRACT

A device for changing pairs of work rolls and/or pairs of backup rolls of roll stands, wherein the rolls are each supported in chocks and are movable out or in by a lower back up roll supported on a track and wheels. The work rolls on the drive side of the roll stand can be coupled to a hydraulic piston-cylinder actuator that is dimensioned in is stroke length for the removal or installation distance and can be uncoupled when it has been withdrawn by the required distance. A roll changing frame can be coupled to the actuator and, when the upper backup roll and the roll changing frame are supported on the lower backup roll, the pair of backup rolls can be moved out or back in. The actuator is coupled to a pusher with connecting arms aligned with ends of the rolls. The actuator is arranged on the drive side of the roll stand and is coupled to the pusher through a piston rod.

7 Claims, 4 Drawing Sheets

METHOD AND DEVICE FOR CHANGING PAIRS OF WORKING ROLLS AND/OR PAIRS OF BACK-UP ROLLS ON ROLL STANDS

BACKGROUND OF THE INVENTION 1. Field of the Invention

The invention concerns a method and a device for changing pairs of work rolls and/or pairs of backup rolls on rolling stands, in which, for chocks that are guided in supporting planes, a linear actuator moves the pair of work rolls supported in the chocks in a direction perpendicular to the rolling direction to remove or install it, and in which the pair of backup rolls, which is supported on a roll changing frame, is moved in or moved out by a linear actuator. 2. Description of the Related Art It is known (EP 1 136 143 A2; DE 31 23 933 C2) that the operation with a roll changing frame for the backup rolls can be carried out by a separate piston-cylinder actuator installed below the level of the mill floor on the tending side of the rolling stand, and in an operation of this type, the actuator requires a stroke length of 5,500 mm or more. This results in a relatively complicated sequence of movements, since, after the removal of the pair of work rolls with the aforementioned actuator, only the lower backup roll is moved out. The roll changing frame is then set on this lower backup roll and moved into the rolling stand together with the lower backup roll, and the upper backup roll must then be lowered onto the roll changing frame. After this operation, the entire unit consisting of the upper backup roll, the lower backup roll, and the roll changing frame situated between them can be moved out. A new set of backup rolls can then be installed in the reverse order. With this method, the lower backup roll is moved into the rolling stand twice and then moved back out. Furthermore, considering the high weights, a great deal of time is required, which could be better spent in other ways.

SUMMARY OF THE INVENTION

The objective of the invention is to develop a modified method to save time during roll changes and at the same time to create the foundation for this by means of a more favorable device.

In accordance with the invention, the stated objective is achieved on the basis of the operational steps mentioned above by coupling the pair of work rolls to the linear actuator and then moving the pair of work rolls out and uncoupling it, and by then coupling the same linear actuator to a roll changing frame that has been moved between the backup rolls, and, when the roll changing frame and the upper backup roll are supported on the lower backup roll, moving them out or moving them back in again as a unit. This saves not only time, because both sets of rolls are moved out once together and then moved in again after the exchange has been made, but also equipment expense, because only one piston-cylinder actuator is needed.

Furthermore, this sole piston-cylinder actuator can be further advantageously used in such a way that the roll changing frame is pushed out of the rolling stand or pulled into the rolling stand from the drive side of the rolling stand by the linear actuator with the work rolls removed. Therefore, advantages are gained both with respect to process technology and with respect to equipment engineering.

The device for changing pairs of work rolls and/or pairs of backup rolls in rolling stands assumes backup rolls and work rolls that are each supported in chocks that can be raised and lowered, so that the pair of work rolls, supported in the chocks, can be moved out by means of a linear actuator, and the pair of backup rolls can be moved out or moved in by means of a lower backup roll supported on a track and wheels and by means of a roll changing frame, which is supported on the lower backup roll and itself supports the upper backup roll.

In accordance with the invention, the device is designed in such a way that the pair of work rolls on the drive side of the rolling stand can be coupled with a hydraulic piston-cylinder actuator that is dimensioned in its stroke length for the removal or installation distance and can be uncoupled when it has been withdrawn the required distance, and that a roll changing frame that has been moved in at the height level between the backup rolls can be coupled to the same piston-cylinder actuator, and then, when the upper backup roll and the roll changing frame are supported on the lower backup roll, the pair of backup rolls can be moved out or moved back in. This saves time during the roll change, and the expense for equipment parts is significantly reduced. For example, only one hydraulic piston-cylinder actuator or a linear drive that operates on some other principle is now necessary.

A further development provides that the piston-cylinder actuator is coupled to a pusher, which has connecting arms aligned with the ends of the rolls. Since the rolls are provided in pairs as work rolls and as backup rolls, and the roll changing frame is also coupled, the connecting arms are simple means of bridging a portion of the path and of creating a point of connection.

The pusher occupies approximately the width of the rolling stand; accordingly, the piston-cylinder actuator now needs to be designed only for the actual displacement distance. This advantage results in the piston-cylinder actuator being installed on the drive side of the rolling stand and in it being coupled to the pusher with its piston rod.

The connection can be quickly created or broken by arranging clamp heads, which correspond to the ends of the work rolls, on the connecting arms of the pusher.

A connection of this type can be further used by providing shaped parts on the roll changing frame that are assigned to each of the connecting arms. The clamp heads can couple or uncouple the shaped parts.

In this regard, the power supply system of the rolling stand can be utilized by actuating the clamp heads hydraulically or electrically.

Accordingly, the roll changing frame can be lowered to or raised from the lower backup roll by means of existing hydraulic apparatuses in the rolling stand.

Similarly, the upper backup roll can be hydraulically lowered to or raised from the roll changing frame.

Another advantage is that the set of rolls comprising the two backup rolls can be removed from the rolling stand by means of the pusher and replaced with a new set of rolls.

Embodiments of the invention are illustrated in the drawings and are explained in greater detail below.

DETAILED DESCRIPTION OF THE INVENTION

Figure 1:
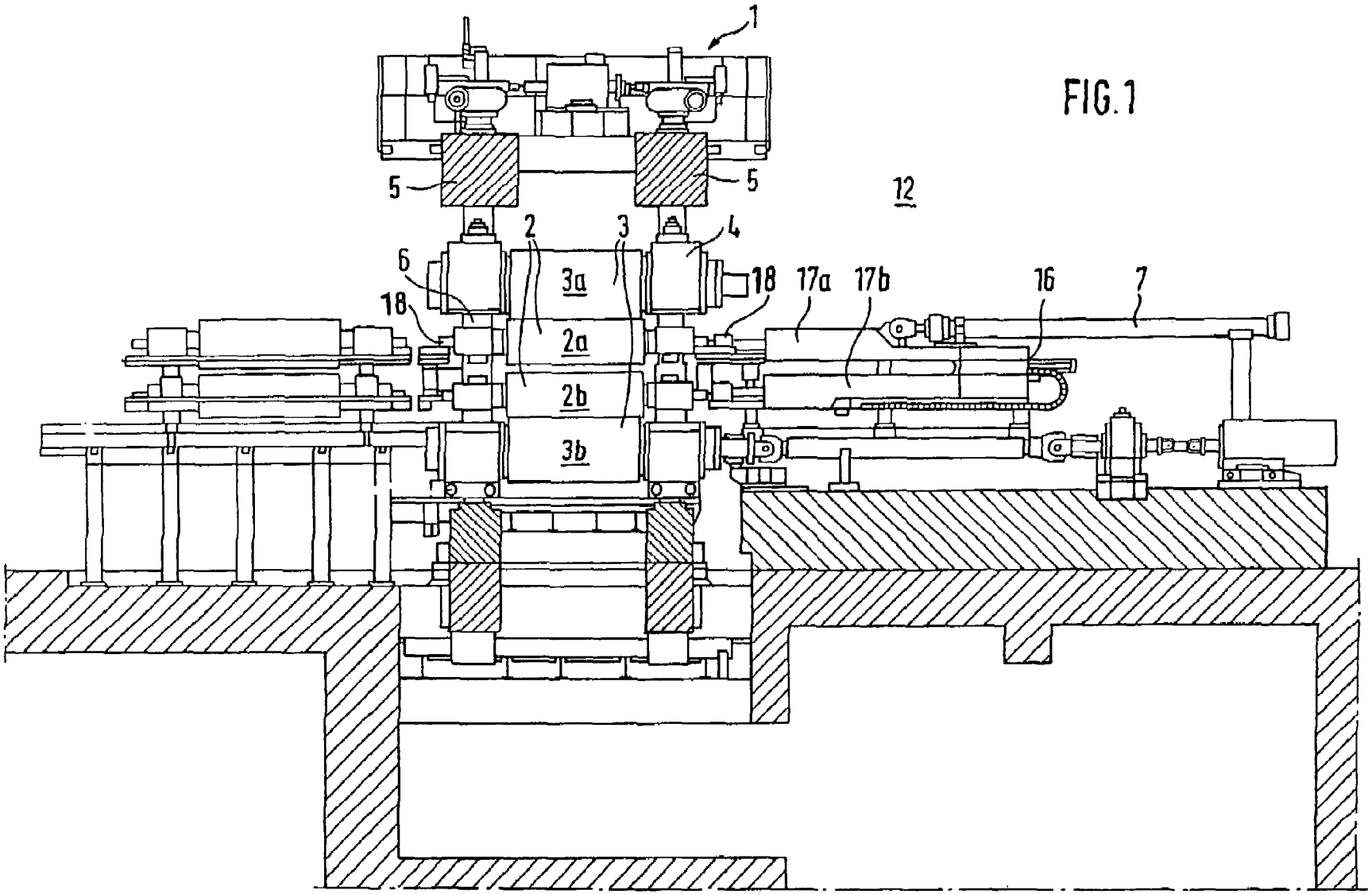
FIG. 1 shows a front view of a complete rolling stand during the removal of the pair of work rolls.
Figure 1A:
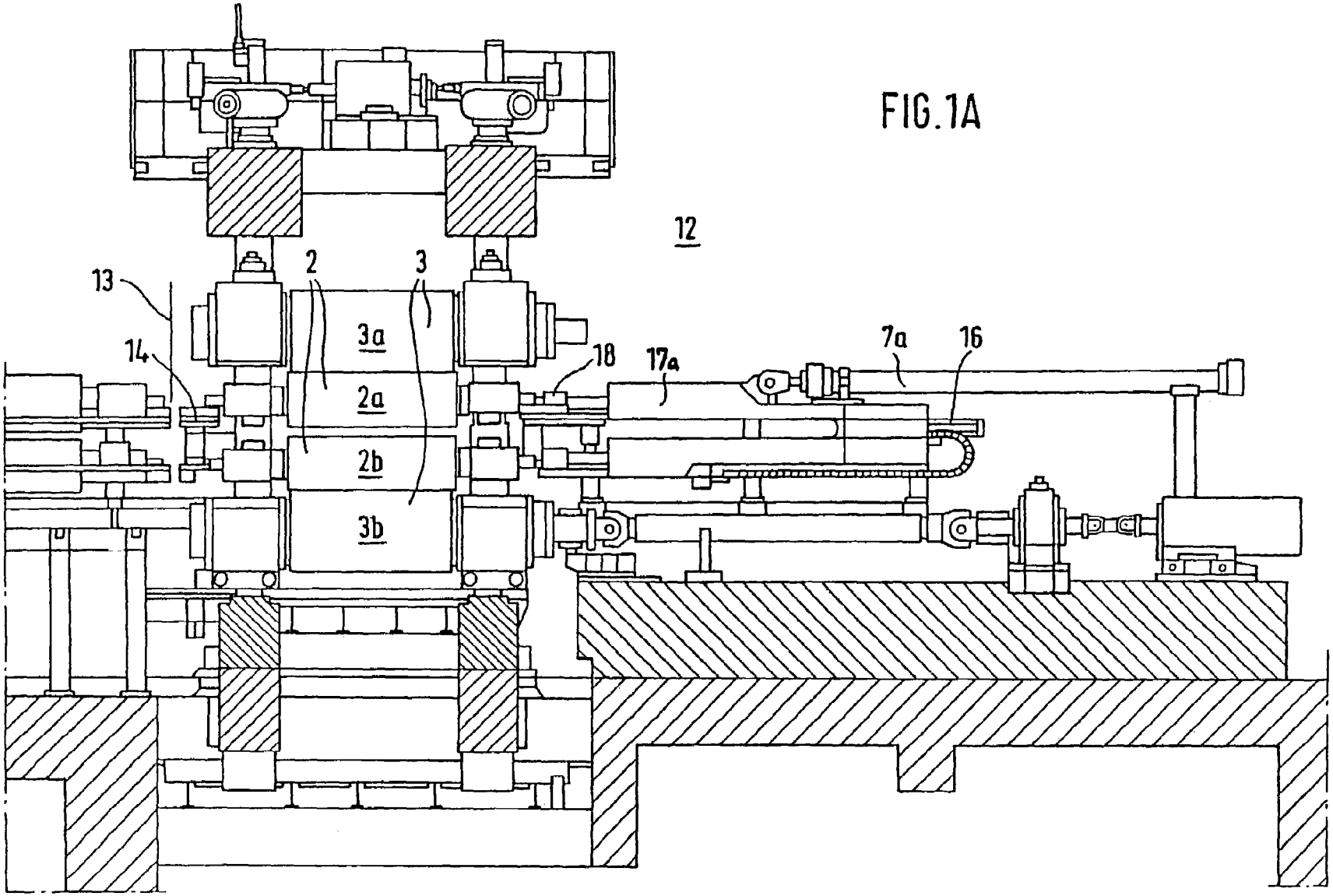
FIG. 1A shows the same view as FIG. 1 but slightly enlarged.

The rolling stand 1 is shown as a four-high stand (FIGS. 1, 1A, 2, 2A) with a pair of work rolls 2, which comprises an upper work roll 2*a* and a lower work roll 2*b*, and a pair of backup rolls 3, which comprises an upper backup roll 3*a* and a lower backup roll 3*b*. The work rolls 2*a*, 2*b* and the backup rolls 3*a*, 3*b* are each rotatably supported in chocks 4, and the chocks 4 are supported in the mill housing frame 5. The work rolls 2*a*, 2*b*, which are kept a certain distance apart by hydraulic apparatuses 6, can be moved in or out by means of a linear actuator 7, which acts on the ends 8 of the rolls.

The invention is designed in such a way (FIG. 1A) that the pair of work rolls 2 on the drive side 12 of the rolling stand 1 is coupled with a hydraulic piston-cylinder actuator 7*a* that is dimensioned in its stroke length for the removal or installation distance 13 and is uncoupled when it has been withdrawn the required distance 14. At the height level 15 between the backup rolls 3*a*, 3*b* (FIG. 2, 2A), the roll changing frame 11 can be indirectly coupled to the same piston-cylinder actuator 7*a* when the upper backup roll 3*a* is supported on the roll changing frame 11 and the roll changing frame 11 is supported on the chocks 4 of the lower backup roll 3*b*, and then moved out as a complete unit 3*a*, 11, 3*b* by means of the piston-cylinder actuator 7*a* and moved back in again after the rolls have been exchanged for a new pair of backup rolls 3.

The piston-cylinder actuator 7*a* is coupled to a pusher 16 with its piston rod 7*b*. The pusher 16 has connecting arms 17*a*, 17*b* assigned to the ends 8 of the rolls, and these connecting arms form an obtuse angle between themselves. Clamp heads 18 are arranged on each of the connecting arms 17*a*, 17*b* of the pusher 16. The clamp heads 18 can be hydraulically or electrically operated.

Corresponding to these clamp heads 18, shaped parts 19 are provided on each roll changing frame 11, which likewise interact with the clamp heads 18. The clamp heads 18 are hydraulically operated together with other adjusting means.

The roll changing frame 11 can be lowered onto the lower backup roll 3*b* by means of hydraulic apparatuses 6 in the rolling stand 1.

Accordingly, the upper backup roll 3*a* is supported by the roll changing frame 11.

The set of rolls consisting of the backup rolls 3*a*, 3*b* and the roll changing frame 11 (FIG. 2, 2A) can be moved out by the pusher 16 and exchanged for a new set of rolls.

Figure 2:
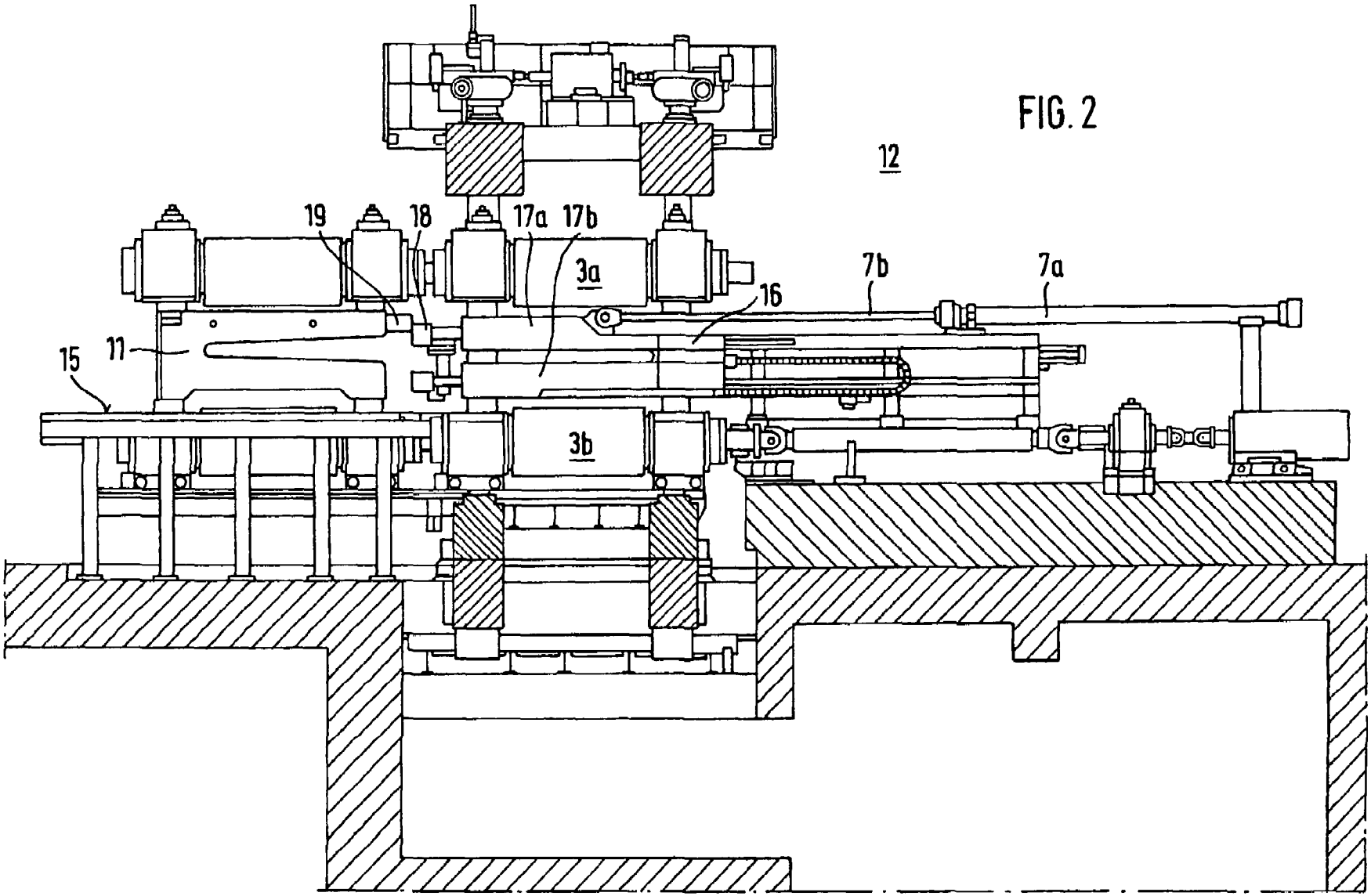
FIG. 2 shows the same front view of the rolling stand during the removal of the pair of backup rolls.
Figure 2A:
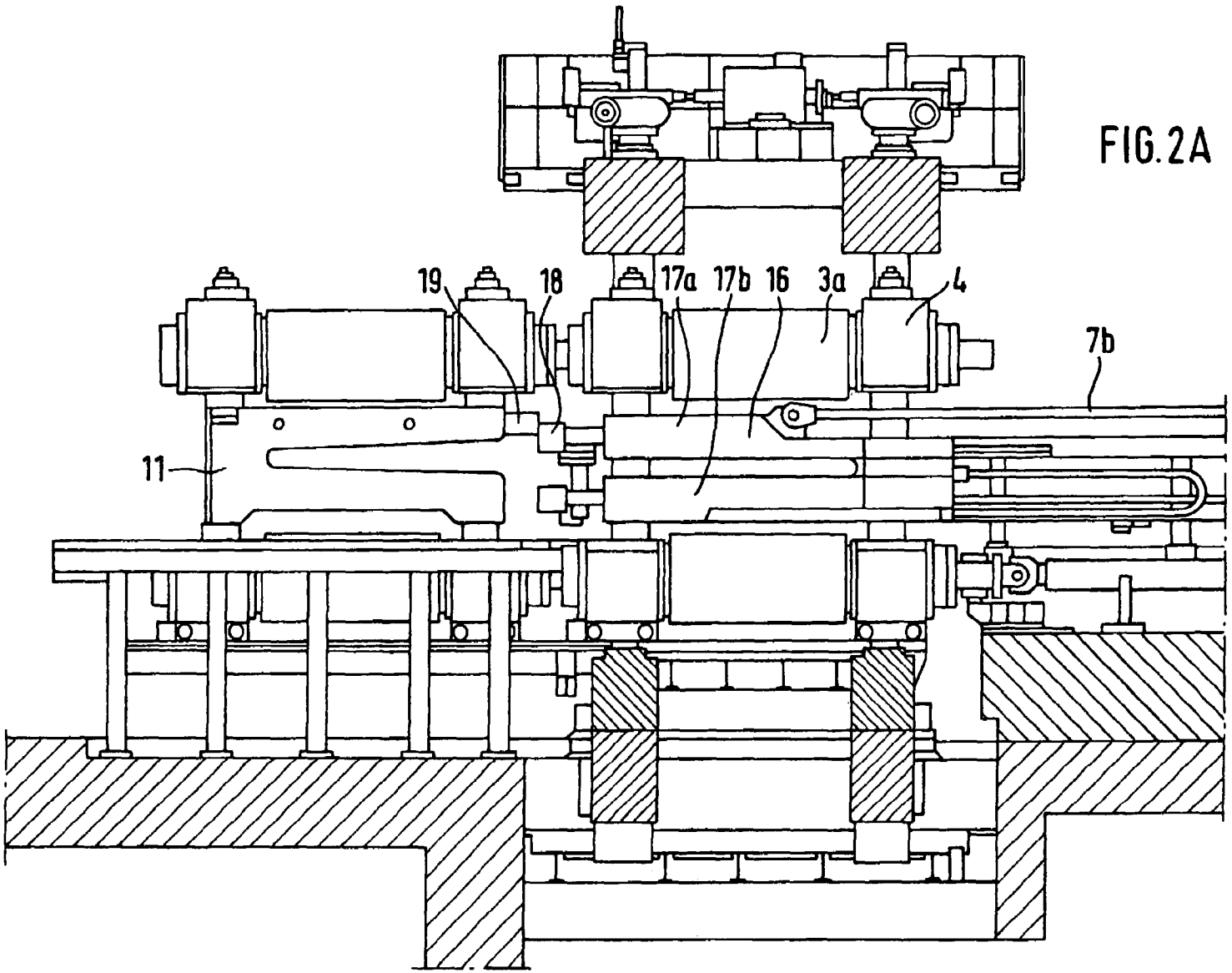
FIG. 2A shows a slightly enlarged view of FIG. 3.

The procedure during the roll change is directed, in a first step, at moving out the pair of work rolls 2*a*, 2*b* after coupling to the linear actuator 7 and then uncoupling them again. In a second step, the same linear actuator 7 is then coupled to the roll changing frame 11, which has been moved between the backup rolls 3*a*, 3*b*, and, after the roll changing frame 11 and the upper backup roll 3*a* are supported on the lower backup roll 3*b*, the unit is moved out or, after exchange for a new unit, moved back in. In this operation, the roll changing frame 11 is pushed out of the rolling stand 1 or pulled into the rolling stand 1 from the drive side 12 of the rolling stand 1 by the linear actuator 7 with the work rolls 2*a*, 2*b* removed (FIGS. 2, 2A)

LIST OF REFERENCE NUMBERS

1 rolling stand
2 pair of work rolls
2*a* upper work roll
2*b* lower work roll
3 pair of backup rolls
3*a* upper backup roll
3*b* lower backup roll
4 chocks
5 mill housing frame
6 hydraulic apparatus
7 linear actuator
7*a* piston-cylinder actuator
7*b* piston rod
8 end of a roll
9 track
10 pairs of wheels
11 roll changing frame
12 drive side
13 installation distance
14 withdrawal distance
15 height level
16 pusher
17*a* connecting arm
17*b* connecting arm
18 clamp head
19 shaped part

The invention claimed is:

1. Device for changing pairs of work rolls and/or pairs of backup rolls on rolling stands, wherein the backup rolls and the work rolls are each supported in chocks that can be raised or lowered in a mill housing frame, the pair of work rolls, supported on the chocks, being movable out by means of a linear actuator, and the pair of backup rolls being movable out or moved in by means of a lower backup roll supported on a track and wheels and by means of a roll changing frame, said roll changing frame being supported on the lower backup roll and itself supporting the upper backup roll, wherein the pair of work rolls (2) on the drive side (12) of the rolling stand (1) can be coupled with a hydraulic piston-cylinder actuator (7*a*) that is dimensioned in its stroke length for the removal or installation distance (13) and can be uncoupled when it has been withdrawn the required distance (14), comprising a roll changing frame (11) which, after having been moved in at a height level (15) between the backup rolls (3*a*, 3*b*), can be coupled to the same piston-cylinder actuator (7*a*), and, when the upper backup roll (3*a*) and the roll changing frame (11) are supported on the lower backup roll (3*b*), the pair of backup rolls (3) can be moved out or moved back in, wherein the piston-cylinder actuator (7*a*) is coupled to a pusher (16) which has connecting arms (17*a*, 17*b*) aligned with ends (8) of the rolls, and wherein the piston-cylinder actuator (7*a*) is arranged on the drive side (12) of the rolling stand (1) and is coupled to the pusher (16) with its piston rod (7*b*).

2. Device in accordance with claim 1, characterized by the fact that wherein clamp heads (18), which correspond to the ends (8) of the work rolls (2*a*, 2*b*), are arranged on each of the connecting arms (17*a*, 17*b*) of the pusher (16).

3. Device in accordance with claim 1, wherein shaped parts (19) assigned to each of the connecting arms (17*a*, 17*b*) are provided on the roll changing frame (11).

4. Device in accordance with claim 3, wherein clamp heads (18) of the connecting arms can each be hydraulically or electrically operated.

5. Device in accordance with claim 1, wherein the roll changing frame (11) can be lowered to or raised from the lower backup roll (3*b*) by means of existing hydraulic apparatuses (6) in the rolling stand (1).

6. Device in accordance with claim 1, wherein the upper backup roll (3*a*) can be hydraulically lowered to or raised from the roll changing frame (11).

7. Device in accordance with claim 1, wherein the set of rolls comprising the two backup rolls (3*a*, 3*b*) can be moved out of the rolling stand (1) by means of the pusher (16) and exchanged for a new set of rolls.

* * * * *